US006981450B1

(12) United States Patent
Adimari

(10) Patent No.: US 6,981,450 B1
(45) Date of Patent: Jan. 3, 2006

(54) GRENADE DISPENSE MECHANISM FOR NON-SPIN DUAL PURPOSE IMPROVED CONVENTIONAL MUNITIONS

(75) Inventor: Louis J. Adimari, Montague, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 561 days.

(21) Appl. No.: 10/042,843

(22) Filed: Jan. 11, 2002

(51) Int. Cl.
*F42B 12/60* (2006.01)

(52) U.S. Cl. ..... 102/489; 102/393; 102/527

(58) Field of Classification Search ..... 102/489, 102/393, 505, 524, 526, 527
See application file for complete search history.

(56) References Cited

U.S. PATENT DOCUMENTS

| | | | | | |
|---|---|---|---|---|---|
| 2,809,583 | A * | 10/1957 | Ortynsky et al. | ..... | 102/393 |
| 3,016,011 | A * | 1/1962 | Brown | ..... | 102/393 |
| 3,981,244 | A * | 9/1976 | Adimari et al. | ..... | 102/489 |
| 4,488,489 | A * | 12/1984 | Schoffl | ..... | 102/489 |
| 4,726,297 | A * | 2/1988 | Bueno et al. | ..... | 102/489 |
| 4,744,301 | A * | 5/1988 | Cardoen | ..... | 102/393 |
| 6,453,821 | B1 * | 9/2002 | Fowler et al. | ..... | 102/527 |
| 6,672,220 | B2 * | 1/2004 | Brooks et al. | ..... | 102/489 |

* cited by examiner

*Primary Examiner*—T. Nguyen
(74) *Attorney, Agent, or Firm*—Michael C. Sachs; John F. Moran

(57) ABSTRACT

A grenade dispensing mechanism for non-spin or low spin dual purpose improved conventional munition launched from inside a projectile. At a pre-determined point along the trajectory, the projectile time fuze which is set at the gun functions to provide initiation output to the payload expulsion charge assembly. The payload expulsion charge assembly contains a propellant which when ignited, produces a gas pressure acting on a pusher plate which acts as a piston. The gas pressure increases with time until the forces of the gas pressure acting on the pusher plate through the grenade payload to the base/tail assembly are sufficient to shear the thread attachment of the base assembly to the projectile body section. An obturator band serves to seal the expulsion gas pressures to prevent excessive gas blow-by as the payload canister assembly travels through the rifled projectile body section. Upon thread shear, the base separates from the projectile body permitting movement of the grenade payload toward the aft open end of the projectile body. The projectile payload section is in the warhead/payload canister assembly. A pre-engraved rotating band attached to the payload canister as it travels through the projectile section rifling creates a torque thus the grenades emerge from the projectile body with rotational and tangential velocity determined by their position in the payload section which cause the grenades to disperse, arm and stabilize to form a large approximately uniform, distribution of grenades in a pattern effects over a target area.

20 Claims, 8 Drawing Sheets

GRENADE DISPENSE MECHANISM FOR NON-SPIN DUAL PURPOSE IMPROVED CONVENTIONAL MUNITIONS

U.S. GOVERNMENT INTEREST

The invention described herein may be manufactured, used or licensed by or for the U.S. Government, for U.S. Government purposes.

BACKGROUND OF INVENTION

I. Field of Invention

This invention applies to the field of artillery projectiles fired from gun platforms and launchers that are known as dual purpose conventional munitions.

II. Background of the Invention

Dual purpose conventional munitions (DPICM) have historically been developed for high spin gun fired artillery projectiles. The changing requirements of the military to achieve longer ranges have dictated the pursuit of fin stabilized guidance projectile warheads with non-spin/low spin characteristics. Projectiles such as the XM 982 and EX-171 extended range DPICM pose unique problems, which require solutions. These are:

a. Grenade fuze arming.
b. Grenade stabilization/orientation.
c. Grenade dispersion for ground pattern effects size and distribution.
d. Need for parasitic dispersal components and hardware, gas generator, and bladder.
e. Maximizing grenade capacity
f. Need for high load bearing joint designs forward and aft of the payload section.
g. Need for a two stage explosion event with use of a pyro delay element design.

In the past, center core burster charges have been used in low spin rocket systems such as the ER-MLRS. This method dispenses grenades through the thin rocket skin without damage to the grenades. The current method used in both the XM892 and EX-171 projectiles makes use of an expulsion charge, pyrotechnic element, gas generator and expandable metal bladder. Additional hardware such as a spine with pusherplate, payload retaining rods, aft bulk head, retainer, melt plugs and pad, are required.

The above past and current techniques were found to be unsatisfactory for a number of reasons.

First, center core bursters do not work successfully in artillery projectiles since by necessity, projectile body walls are made sufficiently thick to survive high gun setback and spin forces. Grenades passing through projectile body walls, if this were possible to achieve, would result in severely damaged components.

Secondly, the current designs for such precision munitions (non-spin) as the Artillery XM982 and EX-171 actually exacerbate overall problems as stated in paragraph 1 above with the use of inefficient and complex expel and dispense hardware. Moreover, the design approaches do not address the task of projectile spin nor do they address grenade fuze arming and stabilization in the air stream.

Accordingly, it is an object of this invention to eliminate inefficient, complex payload hardware adding to projectile weight and cost.

Another object is to provide a projectile which maximizes projectile grenade capacity and provides, hence, for increased warhead lethality.

Yet, another object is to provide the enabling of grenade fuze arming and stabilization/orientation for grenade impact function, providing for increased reliability.

Another object is to provide for improved ground pattern effects area and grenade distribution in the pattern with improved hit probability and reduced overkill.

Another object is to make use of the more effective M80 Dual Purpose Grenade against soft targets, such as personnel, radar, trucks, and launchers.

Another object is to make use of a wide range of dual purpose submunitions rather than just M80 grenades.

Yet, another object is to improve projectile efficiency in terms of cost effectiveness, i.e. lethality/LB and lethality/$ to defeat.

Another object is to reduce or eliminate the need for difficult load bearing joint designs aft and forward of the payload section with the generation of lower expulsion charge pressures required to expel and dispense the grenade payload.

Yet, another final object is to provide a simple design with the use of only six parts, a pre-engraved rotating band and obturator, a pusher plate, an expulsion charge, projectile payload section and payload canister.

Furthermore this invention, as described applies to both non-spin projectiles such as precision munitions and low spin projectiles such as mortars and rocket systems.

Finally, the last object is to replace the two-stage delay function system of the current XM982/EX-171 designs with a one stage expel and dispense mechanism.

SUMMARY OF INVENTION

It has now been discovered that the above and other objects of the present invention may be accomplished in the following manner.

Specifically dual purpose conventional munitions (DPICM) depend on high rates of spin of stabilized artillery projectiles to expel and dispense their grenade payloads over a large target area. These projectiles obtain their high rates of spin during gun launch. As the projectile travels down the gun tube, the projectile rotating band engages the lands and grooves of the rifled gun tube imparting a twisting action or torque to the projectile. The projectile emerges from the gun tube with high spin and velocity. The projectile flies a ballistic trajectory toward the target zone many kilometers down range. At a pre-determined point along the trajectory, the projectile time fuze, which is set at the gun, functions to provide initiation output to the payload expulsion charge assembly. The assembly contains a propellant which when ignited, produces a gas pressure acting on a pusher plate or piston. The gas pressure increases with time (msec) until the forces of the gas pressure acting on the pusher plate through the grenade payload to the base/tail assembly are sufficient to shear the thread attachment of the base assembly to the projectile body section. Upon thread shear, the base separates from the projectile body permitting the movement of the grenade payload toward the aft open end of the projectile body. The grenades emerge from the projectile body with rotational and tangential velocity determined by their position in the payload section. This rotational and translational velocity causes the grenades to disperse, arm and stabilize to form a large, approximately uniform, distribution of grenades in a pattern effects area over the target.

BRIEF DESCRIPTION OF THE PREFERRED DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion and are shown for visual clarity and for the purpose of explanation.

Figure 7A:
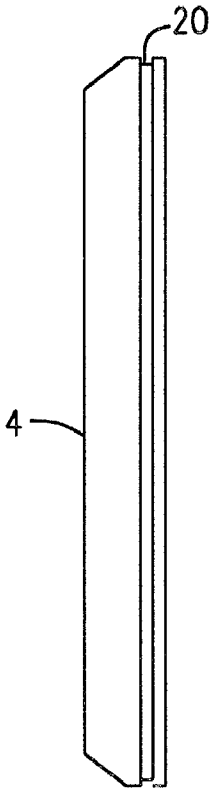
FIG. 7A is a cross sectional view of the pusher plate.
Figure 7B:
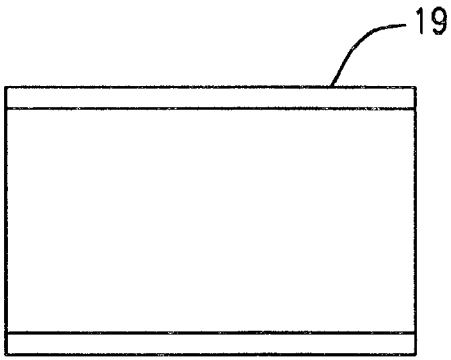
FIG. 7B is a cross sectional view of the grenade adapter.
Figure 7C:
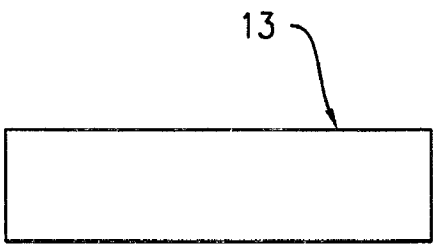

FIG. 7C a cross sectional view of the grenade spacer.

BRIEF DESCRIPTION OF THE PREFERRED EMBODIMENTS

Figure 1:
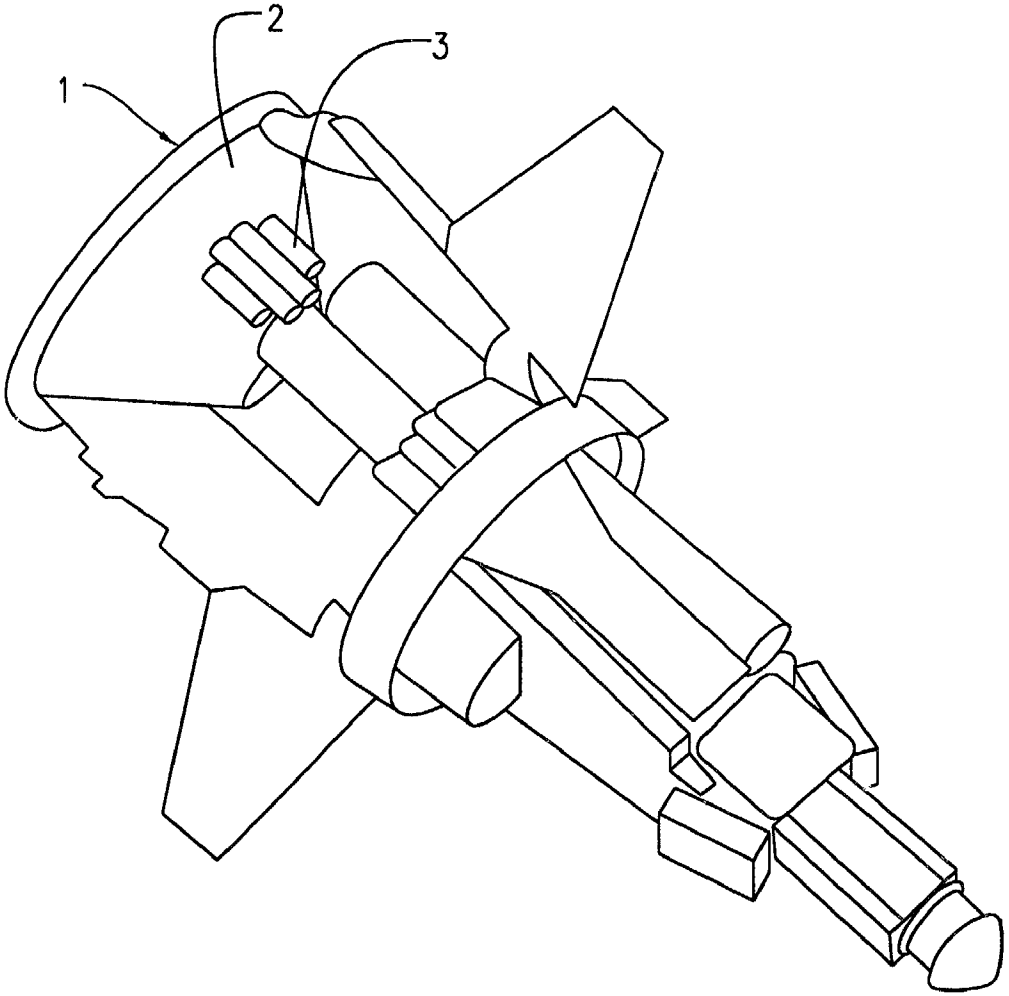
FIG. 1 is a diagram view of the expulsion charge assembly comprising a container with a quantity of propellant charge and the pusher plate.
Figure 2A:
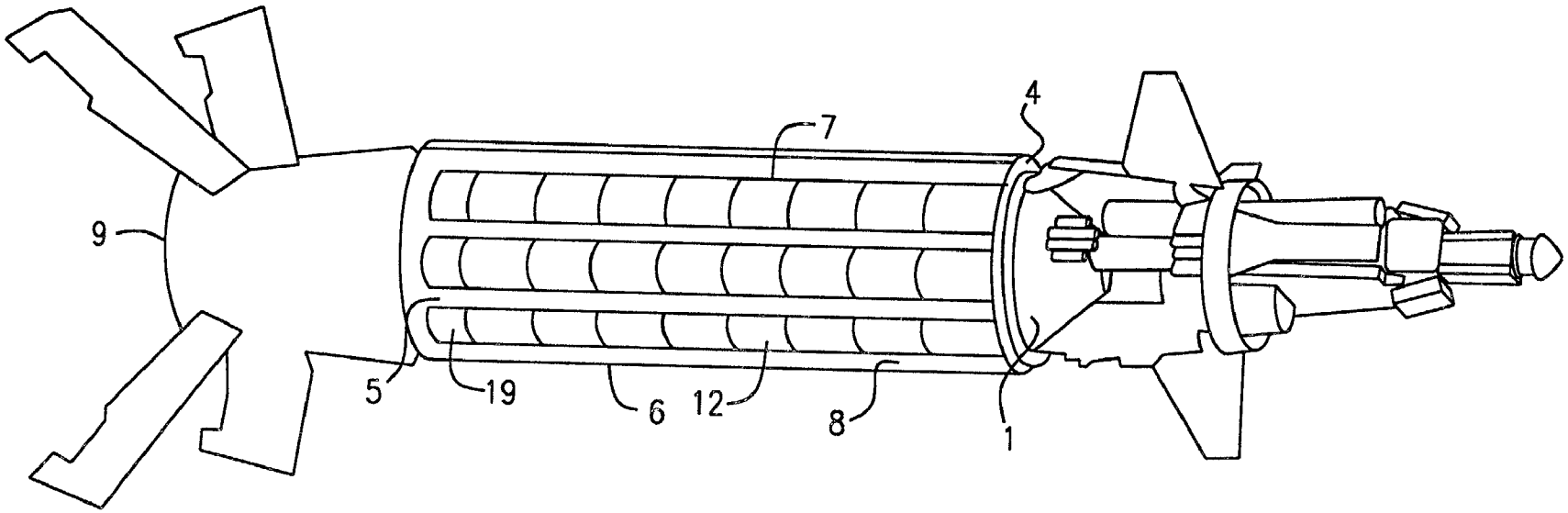
FIG. 2A is a combined diagram of the expulsion charge assembly connected to a cross sectional view of the XM 982 payload comprising 112 XM80 grenades.
Figure 2B:
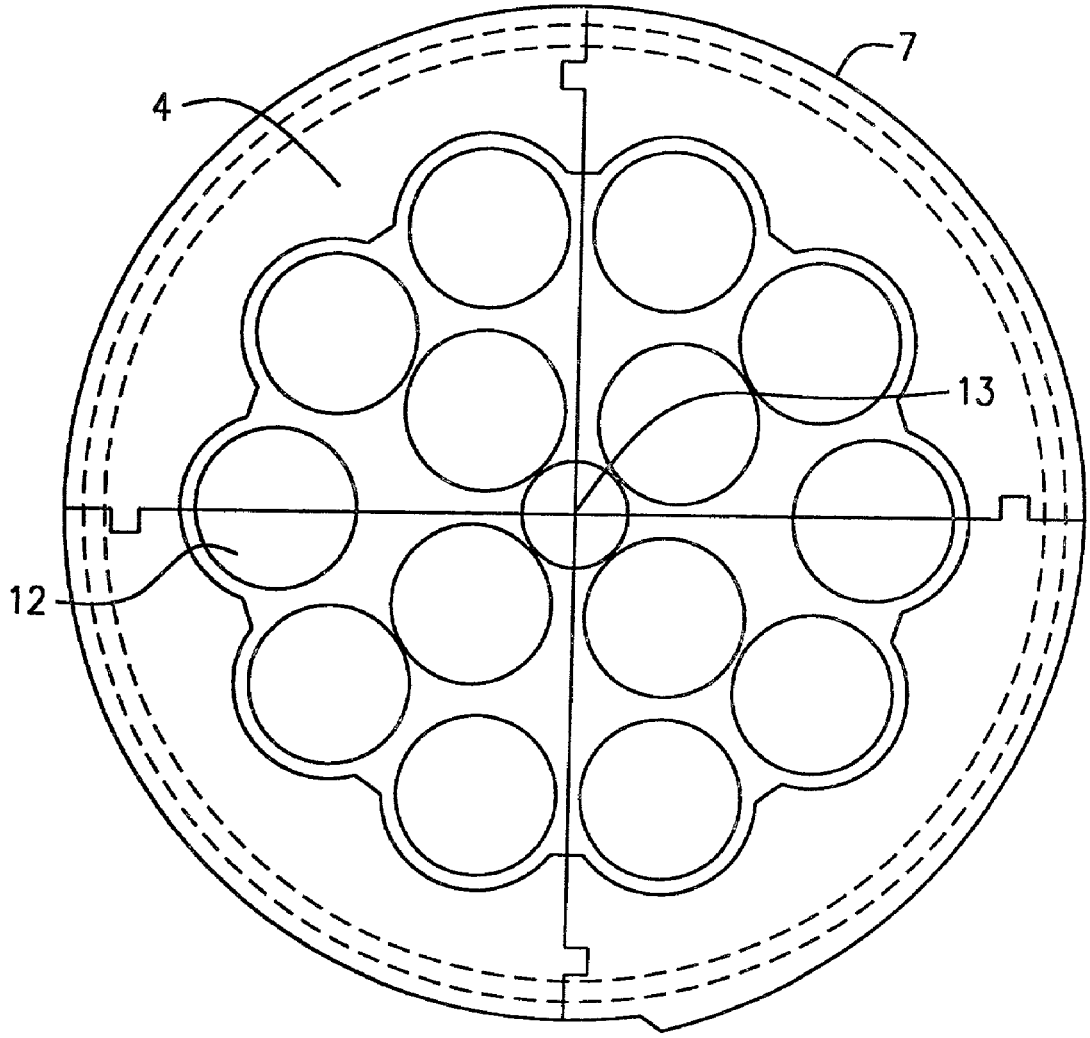
FIG. 2B is a cross sectional view of the payload canister and XM 80 grenades.

Grenade dispense mechanism for non-spin dual purpose improved conventional munitions according to the first embodiment of the present invention is depicted in FIGS. 1–7. With particular reference to FIGS. 1 and 2, the expulsion charge assembly 1 located toward the forward ogival end of the carrier, consists of a container with a quantity of ignitable propellant charge 2 such as M10, ball powder or other comparable propellants. The expulsion charge 2 is ignited by the action of the primary projectile fuze 3 at a predetermined point near or at the target area. The expulsion charge 2 at FIG. 1 produces a gas pressure whose build up in time (msecs) exerts a force on the pusher plate 4 at FIG. 2 located adjacent to the expulsion charge 2 to separate the base end 5 of the projectile 6 to cause the payload canister 7 at FIG. 2A to move rear-ward in the payload section 8 of FIG. 2A.

More particularly, FIG. 2A and FIG. 7C show the pusher plate 4 which acts as a piston to transmit the expulsion gas forces through the payload canister 7 at FIG. 2A to separate the base tail fin assembly 9 by the shearing of threads joining the tail fin assembly 9 to the projectile payload section 8 at FIG. 2A.

Figure 3B:
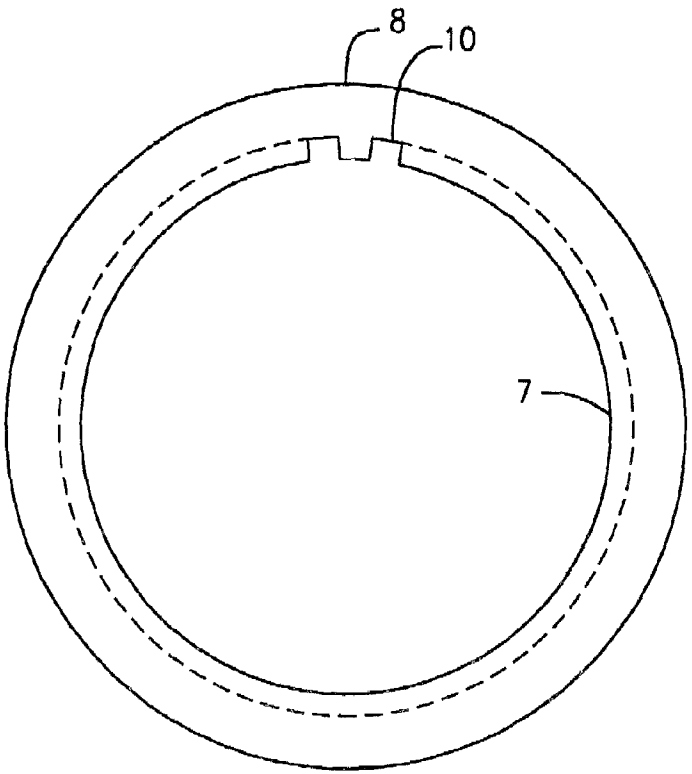
FIG. 3B is a cross sectional view of the projectile payload section rifling design along the line of AA of FIG. 3A.
Figure 3A:
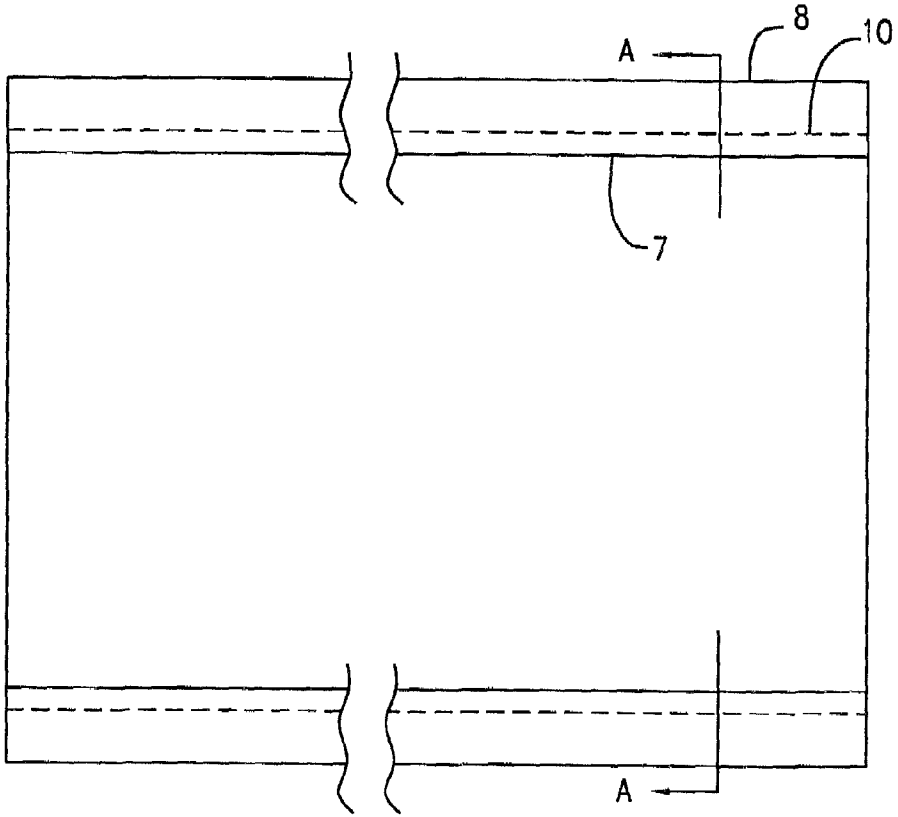
FIG. 3A is a cross sectional view of the projectile payload section rifling design.

FIG. 3A is the cross-sectional view of projectile payload section 8. The projectile payload section 8 contains the space occupied by the warhead or payload canister assembly 7 at FIG. 2A. The internal diameter of the projectile payload section 8 is designed for rifling 10 such as the design of the internal structure of a gun howitzer tube as shown at FIGS. 3A, 3B. The rifled design 10, consisting of an adequate number of lands and grooves, is such as to produce a right handed-clockwise rotation twist as a function of the allowable capacity of the projectile section 8 as viewed from the pusher plate 4 of the payload canister 7 at FIGS. 3A, 3B. The twist angle, Phi, is Tangent Phi equal to 46.321 degrees. The twist of design may be lower or higher as the projectile travel distance of the payload canister 7 will allow and may be of left handed design as to impart reverse spin direction if the projectile, rocket, or mortar system require it to be so. The material for the projectile payload section 8 is high strength 4340 steel, heated treated Rc=43.

Figure 4B:
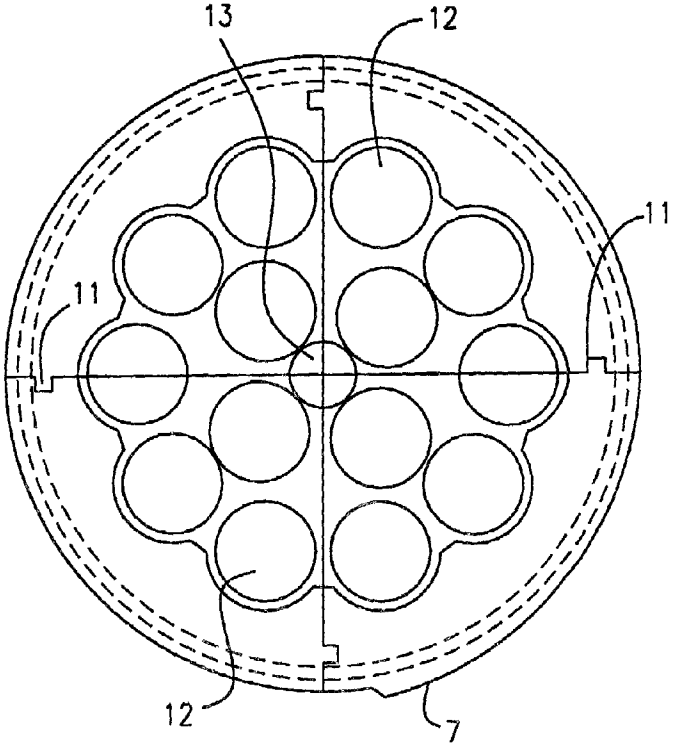
FIG. 4B is a cross sectional view of the payload canister section along the line of BB of FIG. 4A.

FIGS. 4 A,B is the payload canister section 7 which consists of a partitioned steel (4140/4340; heat treated, Rc=43) cylindrical hollow body section, split at 90 degree intervals and joined by a tongue and groove design 11 for enclosing the grenade 12 sub-package, in this case, 14 grenades 12 occupy the cross-sectional space. The inner diameter of the cylinder 7 is shaped in the form of a scallop, seating the outer grenades 12 to prevent them from rotating independently of the cylinder. The inner grenades 12 are held secure within the grenade package by a plastic centering spacer 13 at FIGS. 4B, 7C. The outer rear of the cylindrical section 7 is notched 21 to accept the pre-engraved/engraving copper band 14, FIGS. 5A, 5B and plastic obturator 15, FIGS. 6A, 6B. The payload canister section 7 is situated in the projectile payload section 8.

Figure 4A:
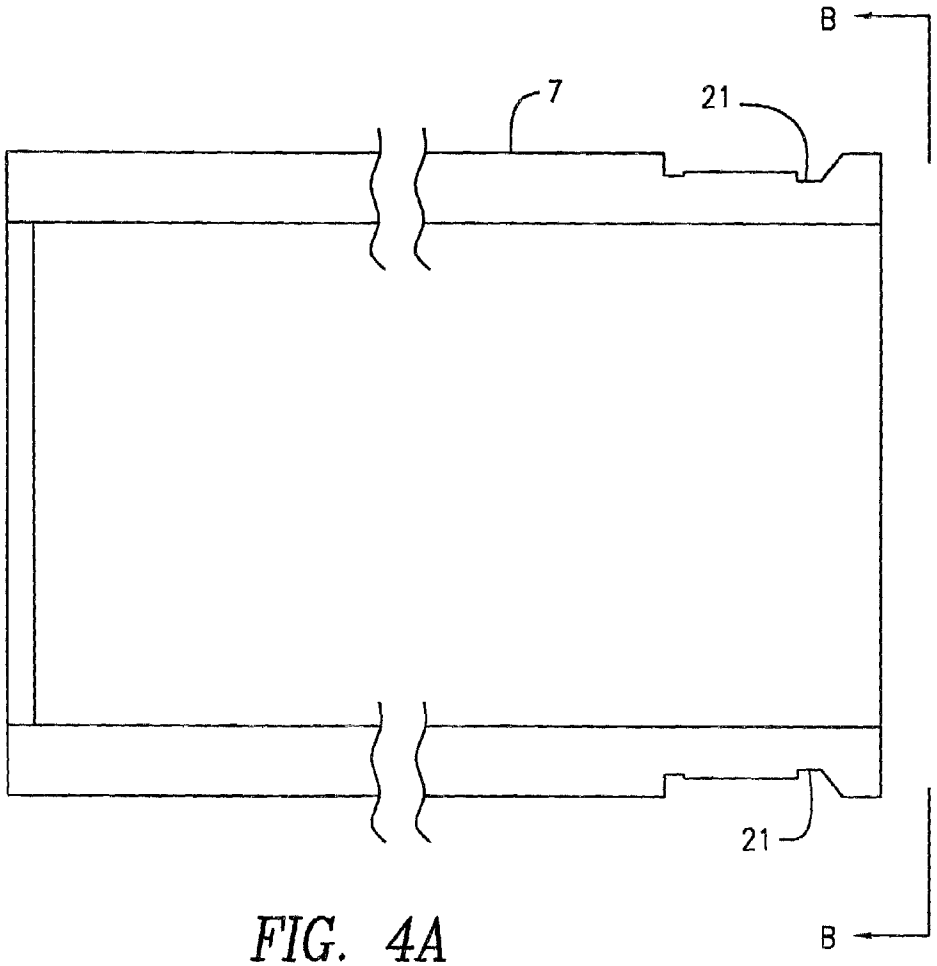
FIG. 4A is a cross sectional view of the payload projectile canister section.
Figure 5A:
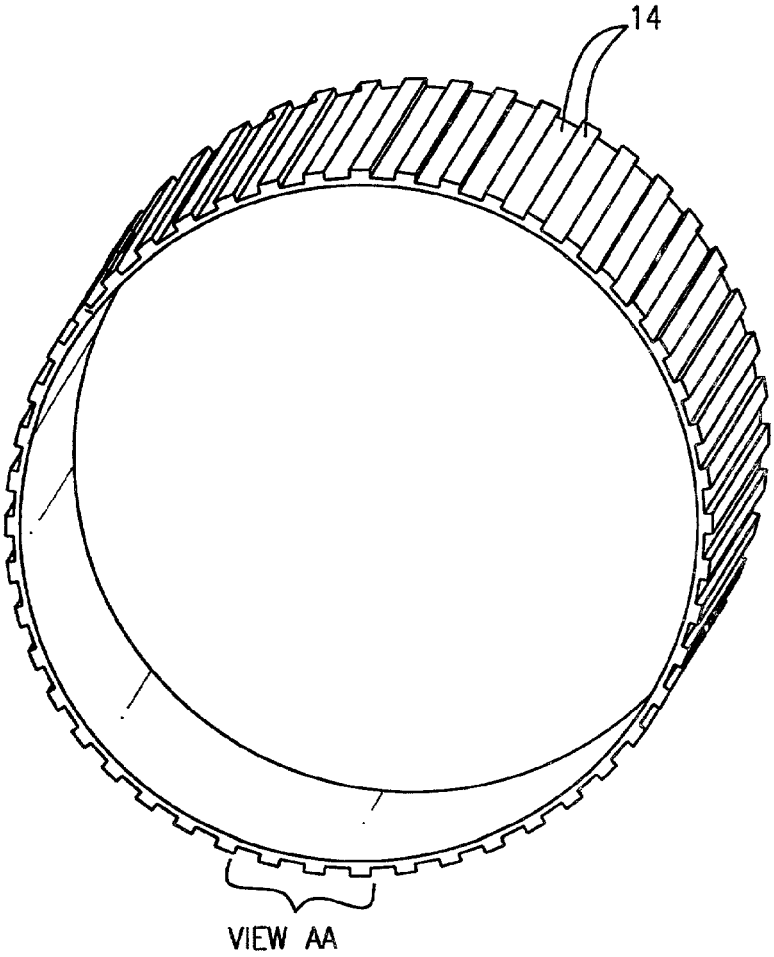
FIG. 5A is a diagram of the pre-engraved rotating band attached to the payload canister section.
Figure 5B:
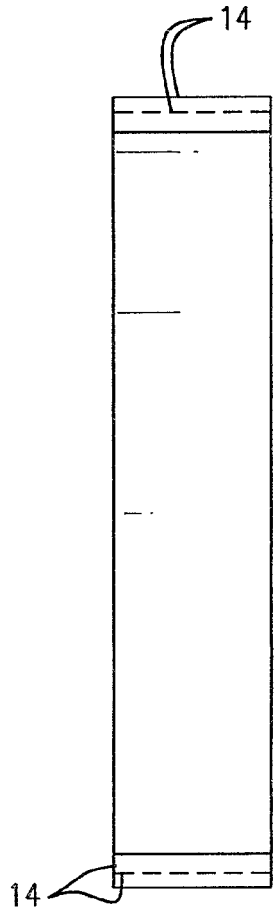
FIG. 5B is a cross sectional view of the pre-engraved rotating band of the band at FIG. 5A.
Figure 5C:
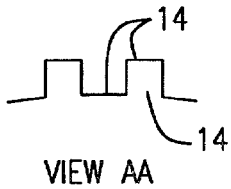
FIG. 5C is a cross sectional view of some of the 43 grooves of the pre-engraved rotating band viewing at AA of FIG. 5A.

Using FIG. 5A, the pre-engraved rotating band 14 is copper material 9% to 12% Zinc, 0.1% to 1.25% Iron, and is attached to the payload canister section 7, FIG. 4A by means of a weld or swage operation. The band 14 is constructed with lands and grooves which fit and pass through the rifled design 10 of the projectile payload section 8 shown at FIGS. 3A, 3B. The friction force created by the action of the pre-engraved band 14 as it travels through the projectile section 8 rifling 10 imparts a torque or rotational motion to the payload canister assembly 7. An adequate number of lands and grooves, which comprise the band 14 which fit and pass through the rifling design 10, are required.

Upon the ignition and action of the expulsion gas forces, the payload canister assembly 7 engages the rifled design 10 of the projectile payload section 8 with its pre-engraved rotating band 14, and after the tail assembly 9 is separated travels through the rifled 10 projectile section 8, making the necessary turns as a function of the allowable capacity of the projectile section 8.

The payload section 7 exits from the projectile 6 with sufficient velocity and spin to cause the canister 7 to separate and disperse the grenades 12. The number of lands and grooves designed for the band 14 may vary depending on the design of rifling selected for the projectile body section 8. The imparting of high spin rates to the grenades 12 overcomes the deficiency of current methods used in non-spin/low-spin artillery systems such as the XM982 and EX-171 Extended Range Fin Stabilized Projectiles. Hence, this process provides for improved reliability of the expulsion event due to enhanced fuze arming and stabilization under spin. The invention also increases lethality delivered to the target by virtue of its capacity to provide much needed space for maximizing grenade 12 capacity and improving therefore the size and distribution of the grenades' 12 ground effects on the target. The scientific principles upon which the invention is based are Newton's laws of motion and the conservation of angular momentum.

An alternate embodiment of the invention would be to use a non-pre-engraved copper rotating band mounted on the payload canister 7. This design will engage the lands and grooves of the rifled projectile body section 8, when under the action of the expulsion gas forces, to provide by its engraving action a torque to the payload canister 7 as it travels along the projectile body section 8.

Figure 6A:
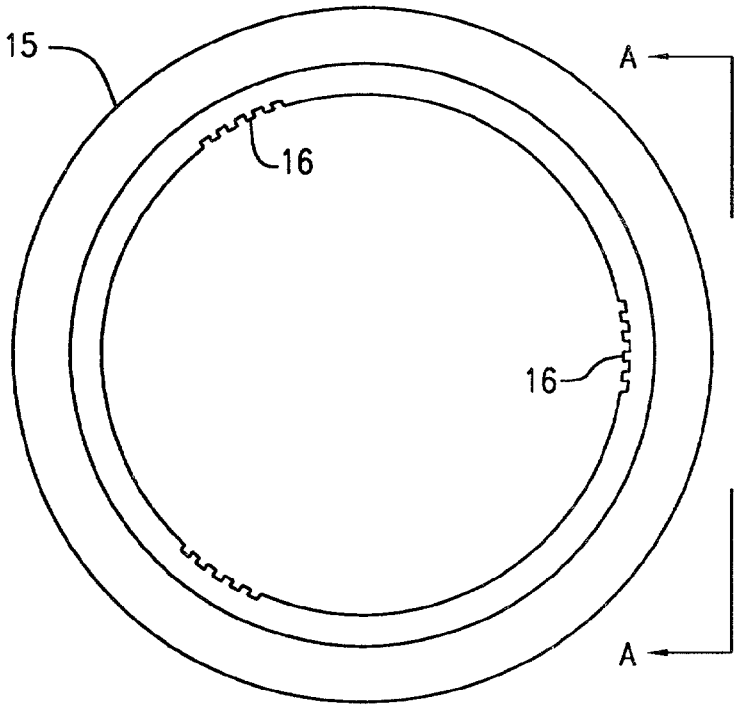
FIG. 6A is a cross section of the obturator band located behind the pre-engraved rotating band and on top of the aft end of the payload canister assembly.
Figure 6B:
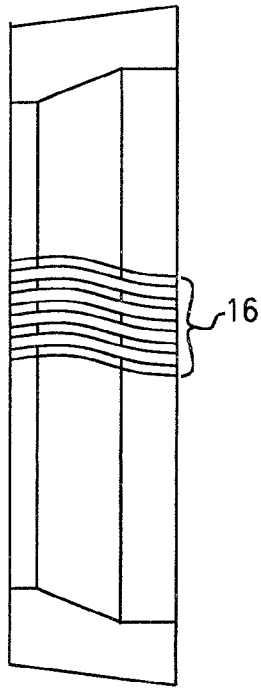
FIG. 6B is a side sectional view of the obturator band from the line AA.
Figure 6C:
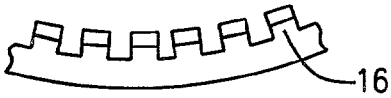
FIG. 6C is a cross sectional view of the area design at view A of FIG. 6A of the obturator band.

FIG. 6A depicts the obturator band 15 made from nylon or polyvinyl material (Spec. MIL-0-60540 w/exception of Para. 3.5). The obturator band 15 at FIGS. 6A, 6B is located behind the pre-engraved rotating band 14 at FIG. 5A and on top of the aft end of the payload canister assembly 7. The band 15 serves to obturate or seal the expulsion gas pressures preventing excessive gas blow-by as the payload canister assembly 7 travels through the rifled 10 projectile body section 8. The obturator 15 can withstand a breaking load of at least 600 pounds (Spec. MIL-A-2550 and ANSI Y14.5 apply). At 120 degree intervals the obturator band 15 is designed with a set of grooves 16 to weaken the band 15 so that it will fall apart under spin forces as it emerges from the projectile body section 8 into the air stream.

FIGS. 7A, 7B, 7C show the pusher plate 4, grenade adapter 19 and spacer 13 respectively. The pusher plate 4 acts as a load-bearing piston which transmits expulsion gas forces to the payload canister assembly 7 driving the assembly through the rifled section of the projectile body section 8 after the base tail fin assembly 9 threads are sheared. The pusher plate 4 material is of 4140 steel construction and may contain a groove 20 to accept an o'ring for additional gas obturation. The pusher plate 4 is 5.525 inches in diameter with a thickness of 0.30 inches.

The spacer 13 is made of plastic material and is of solid cylindrical construction. The spacer 13 purpose is to take-up slack in the payload area so that the inner grenades 12 are made to touch the outer grenades to create a tight pact. The spacer 13 has a length of 1.80 inches and a diameter of 0.233 inches.

What is claimed is:

1. A dispense mechanism for dispensing a payload, comprising:

an expulsion charge assembly located toward a forward end, and including:

a container that contains an ignitable expulsion charge; and a fuze that ignites the expulsion charge;

a payload section that contains the payload;

a pusher plate disposed in proximity to the expulsion charge assembly;

a tail assembly that is secured in a detachable manner to a rearward base section of the payload section by means of an attachment mechanism;

wherein after ignition of the expulsion charge by means of the fuze, resulting expulsion gas forces are generated and cause the pusher plate to act as a piston for transmitting the expulsion gas forces through the payload section, to the tail assembly; and wherein the expulsion gas forces continue to increase until the expulsion gas forces acting against the pusher plate and transmitted through the payload section, to the tail assembly, shear the attachment mechanism of the rearward base section of the payload section to the tail assembly, causing the payload to be dispensed.

2. The dispense mechanism according to claim 1, wherein the payload section comprises a projectile with low-spin characteristics.

3. The dispense mechanism according to claim 1, wherein the payload section comprises a projectile with non-spin characteristics.

4. The dispense mechanism according to claim 1, wherein the expulsion charge comprises a propellant charge.

5. The dispense mechanism according to claim 1, wherein the fuze comprises a primary projectile that ignites the expulsion charge at a predetermined distance from a target.

6. The dispense mechanism according to claim 1, wherein the expulsion gas forces cause the pusher plate to translate within the payload section.

7. The dispense mechanism according to claim 6, wherein the payload section comprises a payload canister that contains the payload; and wherein the payload canister is forced to slide, within the payload section, toward the rearward base section of the payload section, under the action of the expulsion gas forces that are transmitted by the pusher plate.

8. The dispense mechanism according to claim 1, wherein the payload comprises a plurality of grenades.

9. The dispense mechanism according to claim 8, wherein the payload section comprises a grenade adapter and a spacer.

10. The dispense mechanism according to claim 1, wherein the attachment mechanism comprises a threaded section that gets sheared under the action of the expulsion gas forces, to cause the payload section to be detached from the tail assembly.

11. The dispense mechanism according to claim 7, wherein the payload section includes a rifled inner surface for providing a rifled movement to the payload canister, as the payload canister travels axially along the payload section; and wherein the payload section releases the payload with rotational and tangential velocity components.

12. The dispense mechanism according to claim 7, wherein the payload canister includes an outer surface that is notched to mate with a pre-engraved band.

13. The dispense mechanism according to claim 12, wherein the band is made, at least in part, of copper.

14. The dispense mechanism according to claim 7, wherein the payload canister includes an outer surface that mates with an obturator.

15. The dispense mechanism according to claim 14, wherein the obturator's made, at least in part, of an elastomeric material.

16. The dispense mechanism according to claim 14, wherein the obturator's made, at least in part, of a nylon material.

17. The dispense mechanism according to claim 14, wherein the obturator's made, at least in part, of a polyvinyl material.

18. The dispense mechanism according to claim 1, wherein the tail assembly comprises a fin assembly.

19. The dispense mechanism according to claim 7, wherein the canister is a generally cylindrically shaped.

20. The dispense mechanism according to claim 7, wherein the canister is made, at least in part, of steel.

* * * * *